United States Patent [19]

Kumata

[11] 4,362,392

[45] Dec. 7, 1982

[54] ELECTRONIC TIMEPIECE WITH MESSAGE AND/OR ALARM OUTPUT CAPABILITY

[75] Inventor: Kiyoshi Kumata, Kyoto, Japan

[73] Assignee: Sharp Kabushiki Kaisha, Osaka, Japan

[21] Appl. No.: 162,884

[22] Filed: Jun. 25, 1980

[30] Foreign Application Priority Data

| | | | |
|---|---|---|---|
| Jun. 29, 1979 | [JP] | Japan | 54-83157 |
| Aug. 20, 1979 | [JP] | Japan | 54-106217 |
| Aug. 24, 1979 | [JP] | Japan | 54-108490 |
| Sep. 12, 1979 | [JP] | Japan | 54-117516 |

[51] Int. Cl.[3] ..... G04C 19/00; G04B 45/00

[52] U.S. Cl. ..... 368/82; 368/41; 368/73; 364/705

[58] Field of Search ..... 368/3, 9, 10, 12, 72, 368/73, 82-84, 223, 241-242, 250, 251; 364/705, 706, 709, 710, 900, 200; 340/706, 711, 756, 802

[56] References Cited

U.S. PATENT DOCUMENTS

| | | | |
|---|---|---|---|
| 3,925,777 | 12/1975 | Clark | 368/223 |
| 3,999,050 | 12/1976 | Pitroda | 368/10 X |
| 4,117,542 | 9/1978 | Klausner et al. | 364/709 |
| 4,162,610 | 7/1979 | Levine | 368/10 |
| 4,276,541 | 6/1981 | Inoue et al. | 368/251 X |
| 4,298,865 | 11/1981 | Masuzama et al. | 364/710 X |
| 4,303,996 | 12/1981 | Schmitz | 368/82 |

*Primary Examiner*—Vit W. Miska

*Attorney, Agent, or Firm*—Birch, Stewart, Kolasch and Birch

[57] ABSTRACT

An electronic timepieces comprising a first memory for storing a plurality of code information fixedly. A second memory is provided for storing a plurality of code information corresponding to desirable comment or message information, by selectively extracting the code information stored in the first memory. When it is desired to provide the comment or message information, or an alarm time which is preliminarily established is reached, the code information stored in the second memory is read out. A converting circuit is provided by converting the code information generated from the second memory into a particular symbolic pattern providing a specific meaning.

3 Claims, 10 Drawing Figures

ELECTRONIC TIMEPIECE WITH MESSAGE AND/OR ALARM OUTPUT CAPABILITY

BACKGROUND OF THE INVENTION

The present invention relates to an electronic timepiece and, more particularly, to an electronic timepiece with comment or message information and/or alarm output capability.

Conventional electronic timepieces with alarm functions do not comprise means for providing comment or message information relating to alarm time information. Accordingly, even if the alarm time information is provided, the meaning of the alarm is difficult to understand because of the absence of related comment or message information.

Therefore, it is greatly desired that the alarm electronic timepiece be able to point out such comment or message information as to provide a particular meaning to alarm conditions.

SUMMARY OF THE INVENTION

Accordingly, it is an object of the present invention to provide an improved electronic timepiece with the faculties of providing comment or message information.

It is a further object of the present invention to provide an improved electronic timepiece with the faculties of providing alarm information and related comment or message information, the comment or message information being stored in the timepiece.

It is a further object of the present invention to provide an improved electronic timepiece with the faculties of pointing out alarm information and related comment or message information on a display device, the comment or message information being applied to a memory of the electronic timepiece.

Other objects and further scope of applicability of the present invention will become apparent from the detailed description given hereinafter. It should be understood, however, that the detailed description and specific examples, while indicating preferred embodiments of the invention, are given by way of illustration only, since various changed and modifications within the spirit and scope of the invention will become apparent to those skilled in the art from this detailed description.

To achieve the above objects, pursuant to an embodiment of the present invention, an electronic timepiece comprises a first memory for storing a plurality of types of predetermined code information. A second memory is provided for storing a plurality of types of code information corresponding to desirable comments or message information, by selectively extracting the code information stored in the first memory. When it is desired to provide the comment or message information, or an alarm time which is preliminarily established is reached, the code information stored in the second memory is read out. A converting means is provided for converting the code information generated from the second memory into a particular symbolic pattern providing a specific meaning.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
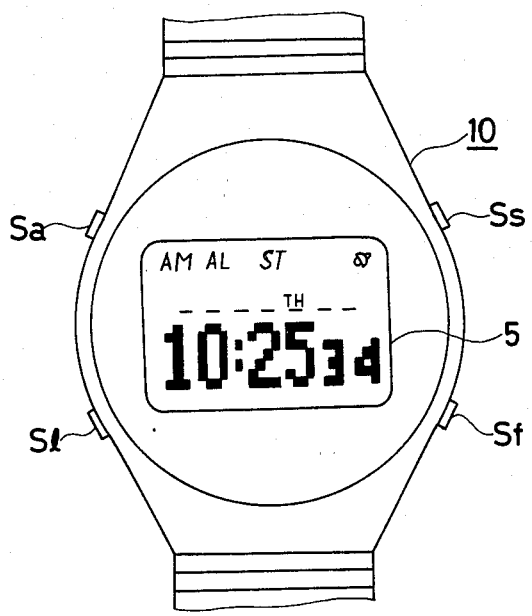
FIG. 1 shows a plan view of an electronic timepiece according to the present invention.
Figure 2:
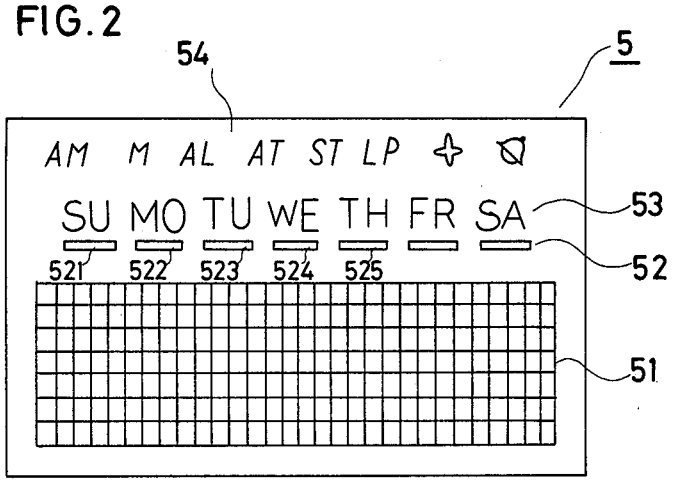
FIG. 2 shows a plan view of a display device included in the electronic timepiece indicated in FIG. 1.

FIG. 1 shows a plan view of an electronic timepiece according to the present invention and FIG. 2 shows a plan view of a display device therein.

With reference to FIGS. 1 and 2, the electronic timepiece denoted as 10 comprises a display device 5, and four switches Sf, Ss, Sa and Sl. The electronic timepiece 10 provides current time information and performs additional functions. The additional functions include indicating independently comment information as a message, providing alarm information, indicating comment information relating to the alarm information to provide a particular meaning when the alarm information is generated, indicating a particular date, and providing stopwatch or chronometrical operations. One of the four switches Sf, Ss, Sa and Sl is actuated to initiate these additional functions or to form any desired comment information within the electronic timepiece 10.

More particularly, the switch Sf is actuated to select a display mode between a normal current time display mode and other additional display modes, and to direct quick advancing operations in a backward direction in generating the comment information. The switch Ss is to select the normal current time display mode and a date display mode, and to switch digit selection in accomplishing a time correction mode for correcting or calibrating the current time information, a comment information formation mode, and an alarm time formation mode. Other objects of the switch Ss are to instruct a start or initiation and stop or termination of time measurement in the stopwatch or chronometrical information mode, and to cancel the comment information which has been formed.

The switch Ss is utilized to instruct the quick advancing operations in a forward direction in conducting the time correction mode, the comment information formation mode, and the alarm time formation mode. It is further utilized to set up arbitrarily the comment information display mode, and to form and cancel the alarm time for use in the alarm time display mode.

The generation of the comment information can be programmed by any of the switches Sf, Ss and Sa. According to a preferred embodiment of the present invention, any type of the comment information can be formed by selecting in desirable combinations the 26 letters of the English alphabet, digits 0 to 9, and a blank character. In this example, a typical form of the comment information comprises five letters. Four kinds of the forms of the comment information can be stored because a memory of the electronic timepiece 10 has storage capacity of 20 letters.

The display device 5 contains a display element 51, an indicator 52, a day-of-week display 53, and a sign indicator 54. The display element 51 is composed of a 7(column)×30 (row) dot matrix display. It indicates the current time, the alarm time which should be formed, and various types of the comment information. The indicator 52 is illuminated to point out the position of the day of the week, and to show the number of the type of comment information in applying the comment information to the electronic timepiece 10. The day-of-week display 53 includes indicia of seven days of the week. The sign indicator 54 contains indicia "A.M.", the comment information "M", and the like.

Figure 3:
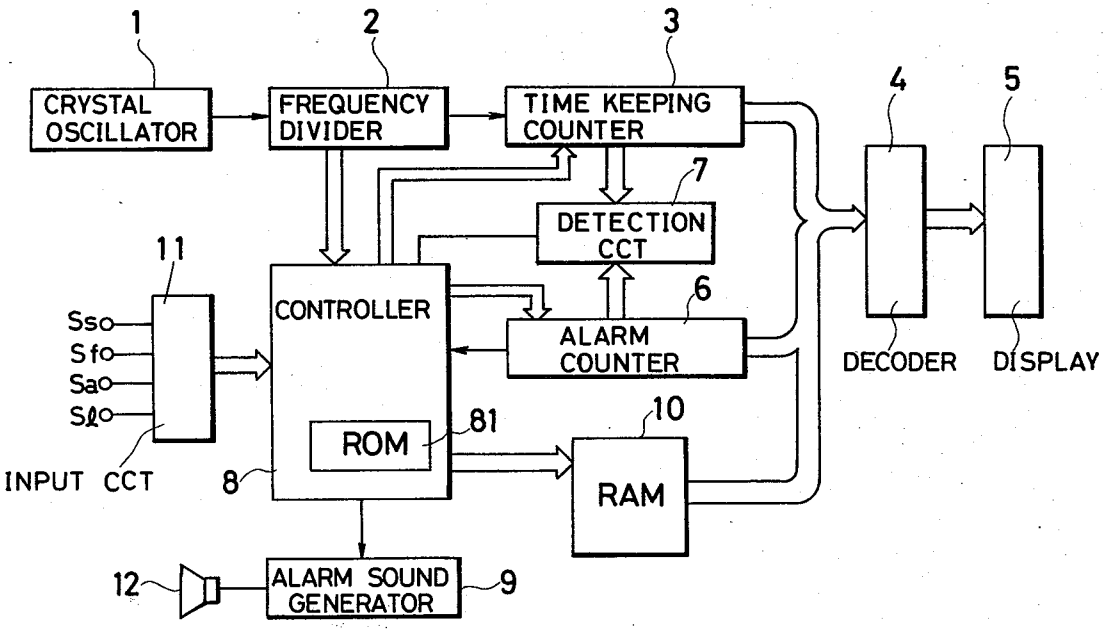
FIG. 3 shows a block diagram of a circuit incorporated within the electronic timepiece indicated in FIG. 1.

FIG. 3 shows a block diagram of a circuit implemented within the electronic timepiece 10. The circuit comprises a crystal oscillator 1, a frequency divider 2, a time keeping counter 3, a decoder 4, a display 5, an alarm counter 6, a detection circuit 7, a controller 8, read only memory (ROM) 81, an alarm sound generator 9, a random access memory (RAM) 10, an input circuit 11, and a speaker 12.

The crystal oscillator 1 is operatively coupled to a crystal resonator (not shown) for generating a time base signal in the form of clock pulses of the frequency of say, 32.768 kHz. The frequency divider 2 is responsive to the clock pulses for frequency dividing the said frequency to a certain frequency which is applied to the controller 8 and lastly to 1 Hz which is applied to the time keeping counter 3 to achieve time keeping operations. Clock pulses are introduced from the controller 8 to the time keeping counter 3 to cause quick advancing operations in the time correction mode in which current time information or date information is corrected.

The time keeping counter 3 is responsive to the output of the frequency divider 2 of the frequency of 1 Hz for generating a horological information signal representative of the current time information in hours, minutes and seconds, and the date information such as the date of the month, the day of the week, and the month. The horological information signal enters the decoder 4.

The alarm counter 6 is assumed to contain the alarm time information and the comment information corresponding thereto. Any type of information can be formed as the alarm time information and the comment information by the operator. The detection circuit 7 is provided for determining the equivalency between the alarm time information and the current time information measured by the time keeping counter 3. When it is detected, the detection circuit 7 generates detection signals to the controller 8.

The controller 8 is responsive to the detection signals for energizing the alarm sound generator to provide pieces of alarm sound from the speaker 12. All of the switches Ss, Sf, Sa and Sl are connected to the input circuit 11 to provide input signals from them. The controller 8 includes the ROM 81 as a first memory. The ROM 81 contains a plurality of types of first code information corresponding to all the 26 letters of the English alphabet, and the digits 0 to 9.

When either the switch Sf or switch Sa is actuated, the first code information is subsequently and repeatedly generated from the ROM 81. Once the switch Ss is actuated during the generation of the first code information, the first code information at the time the switch Ss is actuated is selected to be applied to the RAM 10 as a second memory for storage purposes. It stores a certain number or type of second code information forming the comment information, the second code information being produced in response to the first code information generated from the ROM 81.

Responsive to the detection signals from the detection circuit 7 into the controller 8 or the actuation of the switch Sf, the RAM 10 outputs the second code information into the decoder 4. The decoder 4 functions to convert the current time information generated from the time keeping counter 3, the alarm time information from the alarm counter 6, and the second code information from the RAM 10 into one or more letter patterns in the form of the dot matrix. Information of the one or more letter patterns is applied to the display device 5 so that the display element 51 shows the one or more letter patterns.

Among the information from the time keeping counter 3, the current time information such as "A.M." and "P.M." information, and the date information such as the day of the week are applied to the indicator 52, the day-of-week display 53, and the sign indicator 54, for indication purposes. The month information and the date of the month information are indicated in the display element 51 by replacing the current time information such as the hour, minute and second. One letter inclusive of the current time information and the comment information both shown in the display element 51 comprises 5 dots in horizontal length and 7 dots in vertical length.

Figure 4:
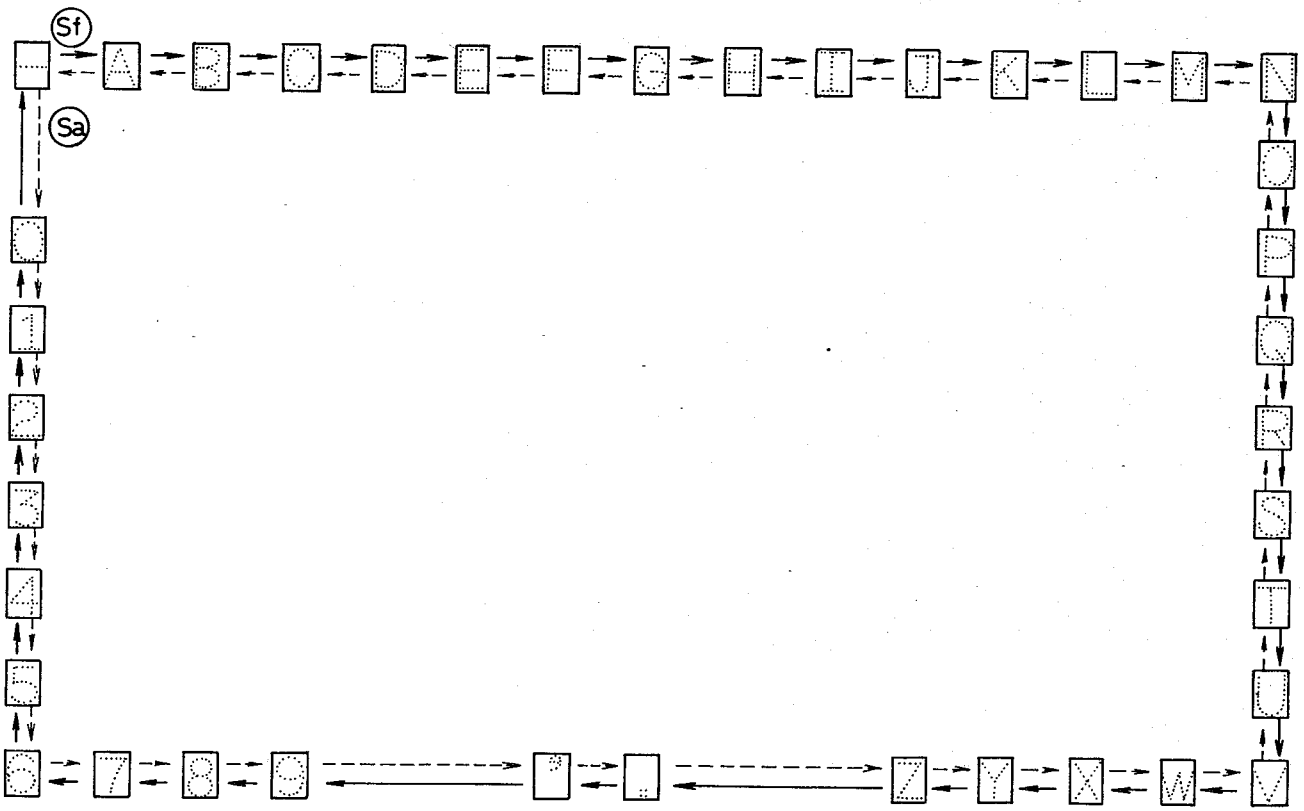
FIG. 4 shows sequential display conditions of letter patterns which are obtained from certain parts of code information by conversion, the code information being developed from a memory of the circuit of FIG. 3.
Figure 5:
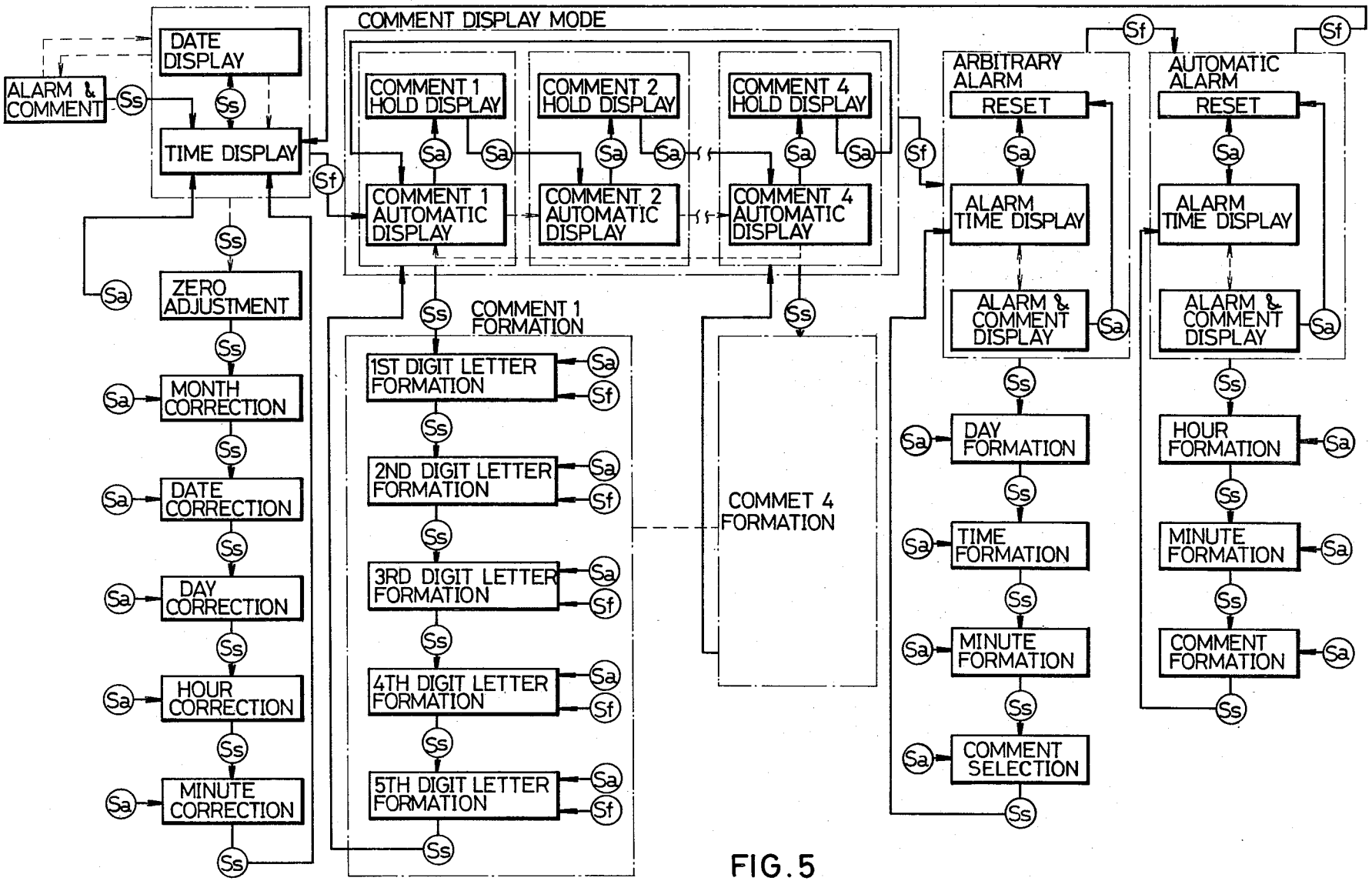
FIG. 5 shows a general flow chart representing operations of the electronic timepiece for use with the present invention.
Figure 6:
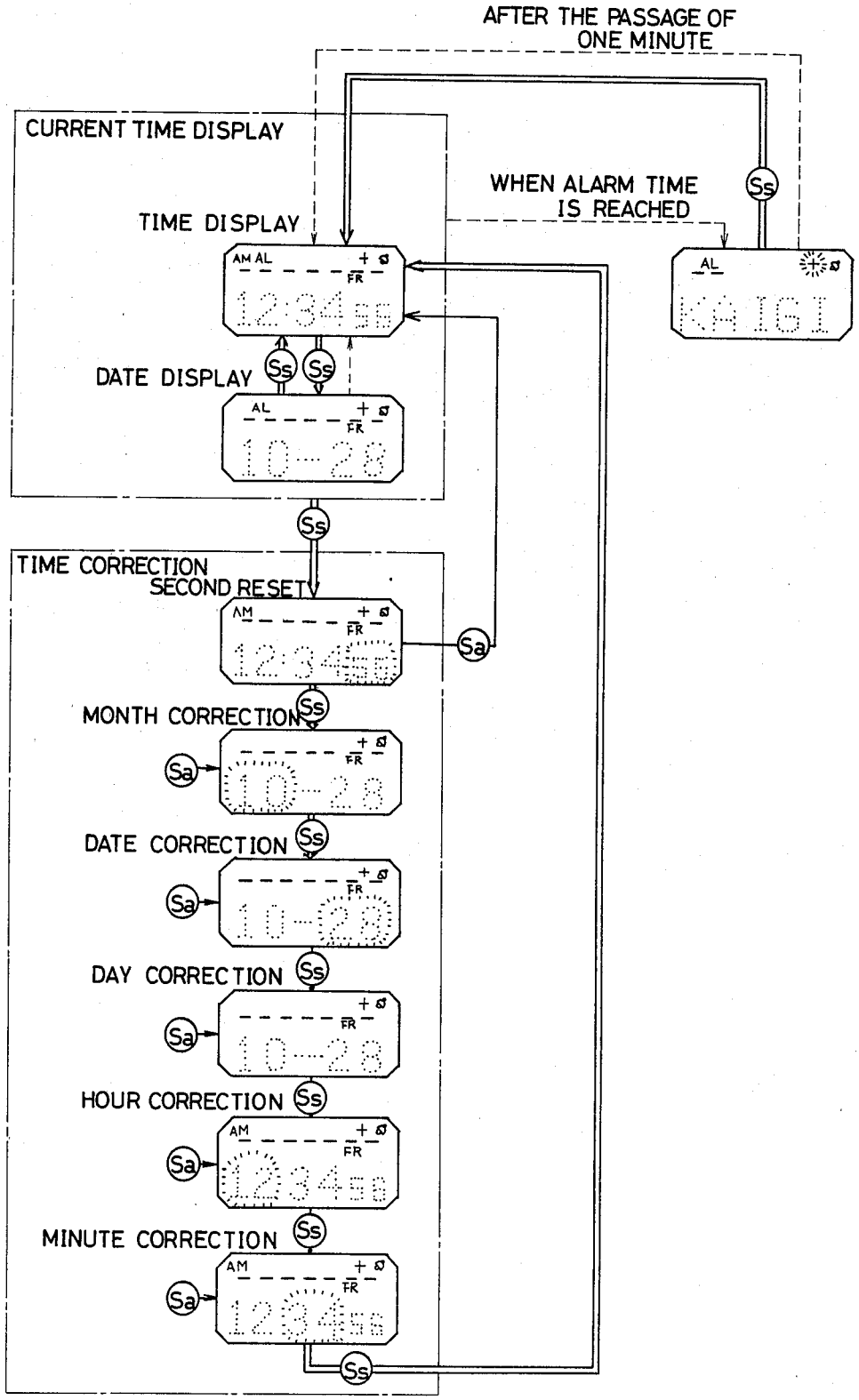
FIG. 6 shows a specific flow chart representing operations of the electronic timepiece in its current time display mode for use with the present invention.
Figure 7:
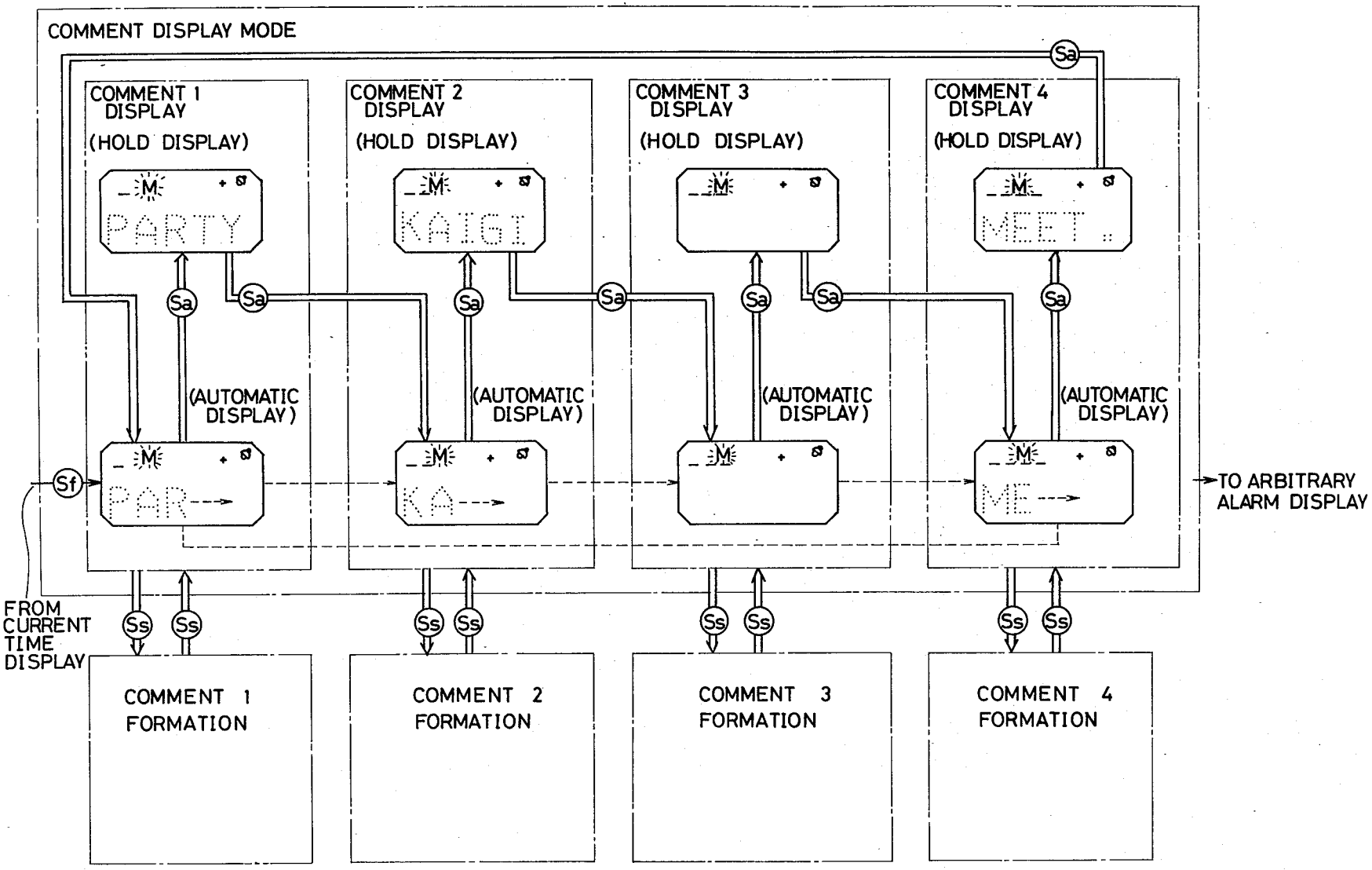
FIG. 7 shows another specific flow chart representing operations of the electronic timepiece in its comment or message information display mode for use with the present invention.
Figure 8:
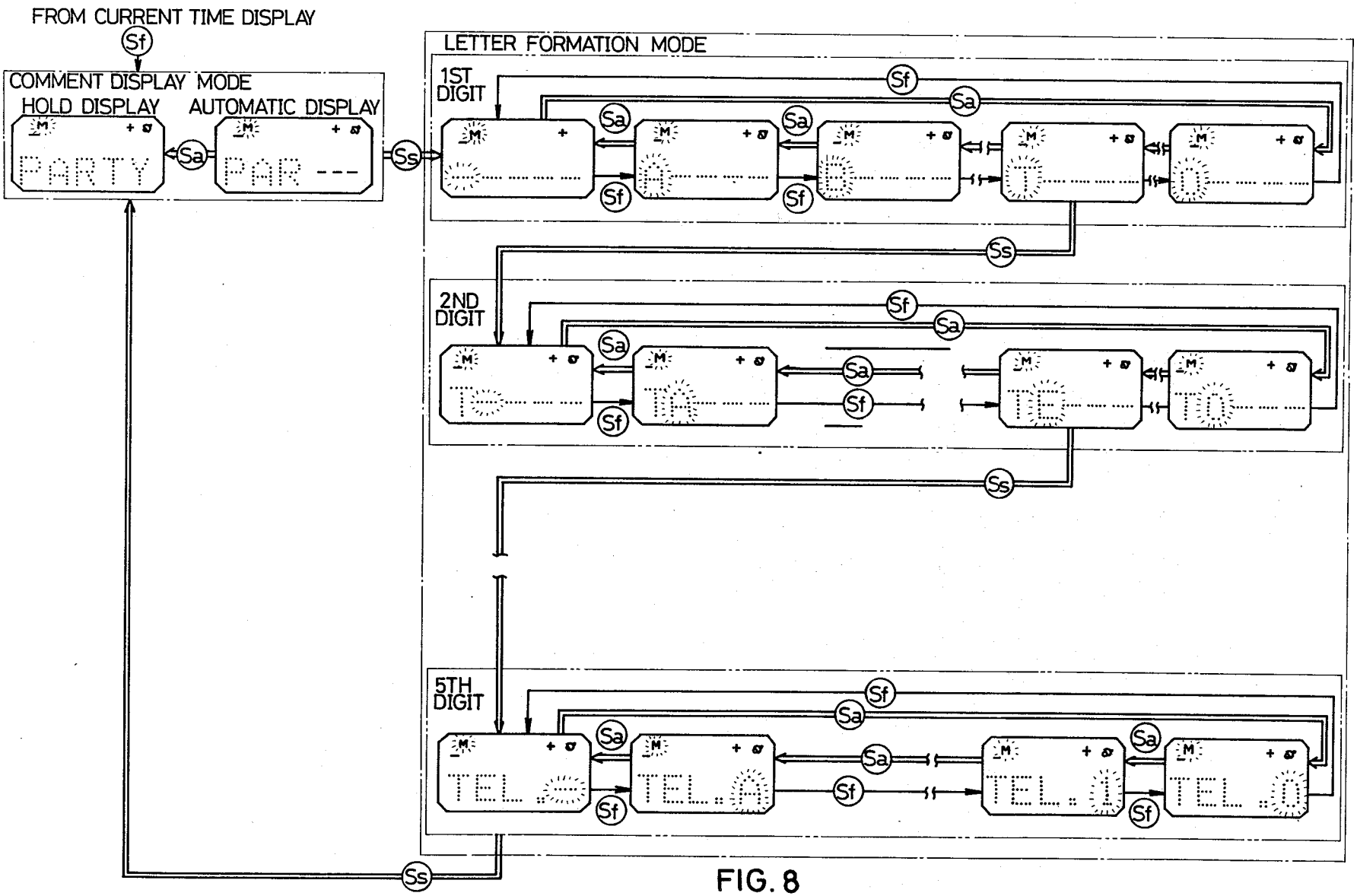
FIG. 8 shows a further specific flow chart representing operations of the electronic timepiece in its letter information formation mode for use with the present invention.
Figure 9:
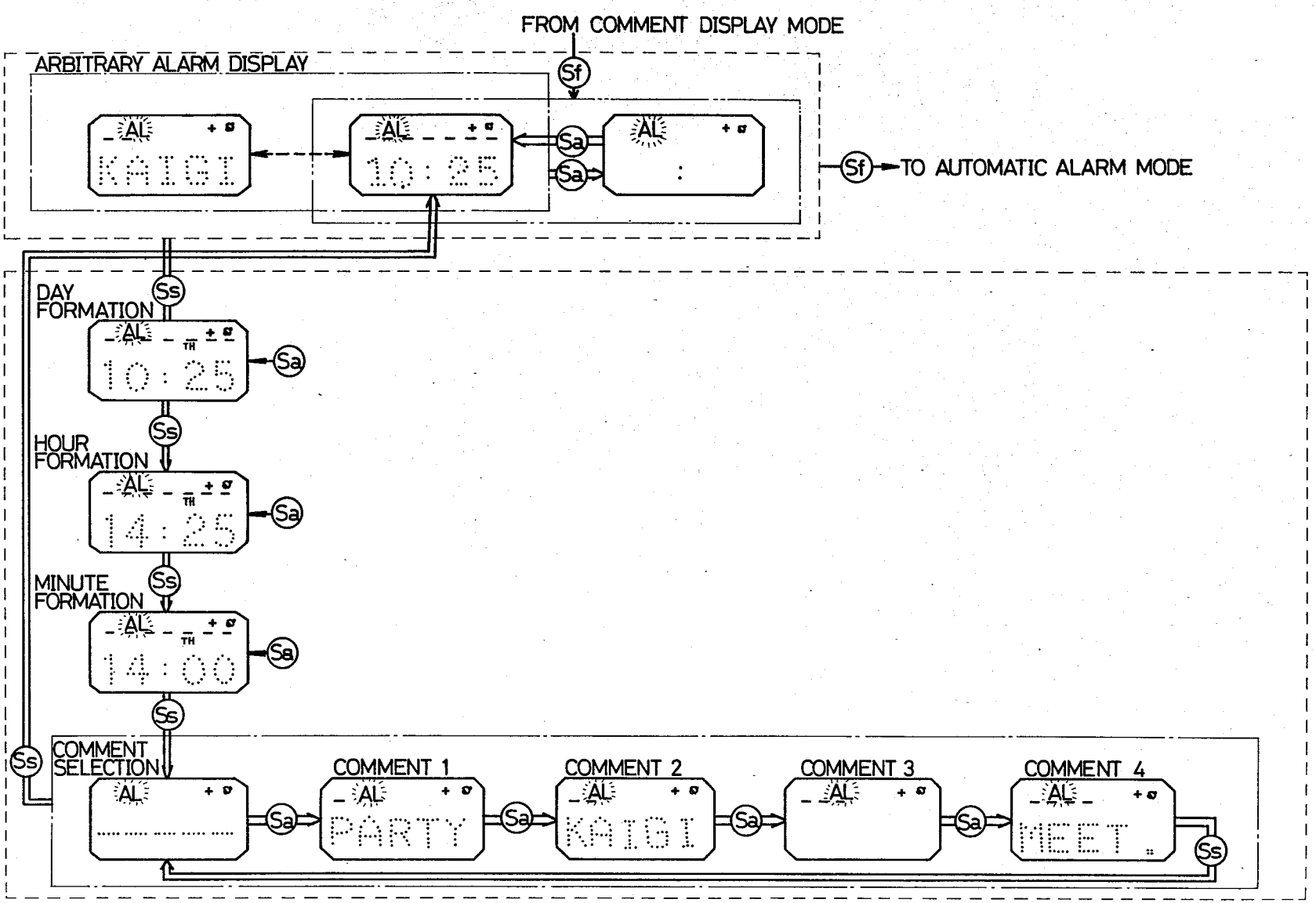
FIG. 9 shows a further specific flow chart representing operations of the electronic timepiece in its arbitrary alarm display mode for use with the present invention.

FIG. 4 shows a sequential display of the letter patterns obtained by the first code information from the ROM 81. FIG. 5 indicates a general flow chart representing operations of the electronic timepiece 10. FIG. 6 points out a specific flow chart representing operations of the electronic device in its current time display mode. FIG. 7 shows another specific flow chart representing operations of the device in its comment information display mode. FIG. 8 shows a further specific flow chart representing operations of the device in its letter information formation mode. FIG. 9 indicates a further specific flow chart representing operations of the device in its arbitrary alarm display mode.

With reference to FIGS. 1 to 9, the operations of the electronic timepiece 10 are described in detail. Firstly, referring to FIGS. 5 and 6, time correction controls of the current time information and of the date information in the current time information display mode are explained.

Since almost all the time correction controls per se by the use of these switches, except for the controls only related to the present invention, are well known to those skilled in the art, it is not believed necessary to describe in detail these known various controls by the switches. On the other hand, the controls only related to the present invention will be more specifically described hereinafter with reference to a circuit configuration adapted for such controls.

Firstly, the switch Ss is kept actuated for a predetermined time-period to initiate the time correction mode. On this occasion, the output signals from the time keeping counter 3 are introduced in the display element 51 through the decoder 4, so that it indicates the current time information. Then the switch Sa is actuated so that second digit information of the time keeping counter 3 is reset to zero. Simultaneously the current time display mode commences.

Instead of the actuation of the switch Sa, the switch Ss is activated so that the controller 8 allows the indication of the date information from the time keeping counter 3 in place of the indication of the current time information. Then the switch Ss is further activated so that figures in the month digit are made quick advancing indications. Just when any desired figure is shown, the switch Ss is actuated where figures in the date digit are selected to allow quick advancing indications. Then the switch Sa is actuated to start the quick advancing indications until any desired figure is shown.

Each time the switch Ss is actuated, the display digits in which the figures are made quick advancing indications are in turn selected. When the switch Sa is actuated during the time any desired display digit is selected, the figures of the display digit are subject to the quick advancing indications, in which case any desired figure can be selected to be set in the circuit. By the actuation of the switch Ss after any desired figure is selected in the minute digit, the current time display mode is put back.

By the actuation of the switch Ss during a predetermined time period, the current time display mode are changed to the date display mode.

By the further actuation of the switch Ss after or during a predetermined time period, the current time display mode replaces the date display mode automatically. After the day of the week information is established in the time correction mode, the current time information is indicated in place of the display of the date information.

The comment information display mode and the letter information formation mode are explained referring to FIGS. 1 to 4, and FIGS. 7 to 8. By the actuation of the switch Sf at the time the display element 51 points out the current time information, the comment information display mode is enabled. In such a case, the switch Ss is operated to disenable the indication of the current time information. The display element 51 is adapted to indicate blank information of "- - - - -", in which the first digit "-" of the blank information is turned on and off. It means that the first digit of the comment information can be established.

The number of pieces of comment information is indicated in parts 521 to 524 of the indicator 52. When the first piece of comment information is permitted to be formed, the controller 8 permits the part 521 to be turn on and off. When forming the second piece of comment information, the part 522 goes on and off. In the same manner, the parts 523 and 524 go on and off, respectively.

When the switch Sf is operated, the controller 8 causes the ROM 81 to develop the second code information representing the letter information. The second code information developed enters the decoder 4. The decoder 4 changes the second code information into the letter patterns, which are indicated in the first digit of the display element 51. As shown in FIG. 4, various types of patterns "-", "A", "B", . . . "Y", "Z", and "9" to "0" are indicated in a circulating manner. The quick advancing operations are stopped at the time any desired letter, say, "T" is presently displayed in the first digit as shown in FIG. 8. Subsequently, the switch Ss is activated so that the letter information "T" is established in it. At the same time the blank information "-" in the second digit of the display element 51 goes on and off to represent that the establishment of the comment information into it is possible. Responsive to the actuation of the switch Sf the figures in the second display digit are subject to the quick advancing indications from the blank information "-" to the figure "0" in the circulating manner.

While circulation of the letters display is enabled as pointed out in FIG. 4, the switch Sa is operated with the object that it is developed in the reverse direction from the last item. In such a case the indication of the letter information, the blank information "-", the figures "0" to "9", and lastly all the 26 letters of the English alphabet from "Z" to "A", is developed in the reverse order from the circulation direction initiated by the actuation of the switch Sf. Addresses applied to the ROM 81 are consequently subtracted during reverse circulation.

Activation of the switch Sa allowing the reverse quick advancing indications is terminated when any desired type of letter information is reached. Accordingly, the switch Ss is activated to establish the type of letter information, say, "E" in the second display digit. At the same time, the controller 8 allows the RAM 10 to contain code information corresponding to the letter information illustrated in the respective digits in the display element 51.

The blank information "-" can be shown in a display digit by means of disabling the switches Sf and Sa or of selecting the display by the controls of these switches. Responsive to the switch Ss the blank information can be established so that its corresponding code information is stored in the RAM 10.

By the same manner, a piece of comment information comprising 5 letters, say "TEL . O", is formed. Subsequently the switch Ss is actuated so that the comment display mode is selected again. When it is desired that another type of comment information be formed, the switch Ss is activated to select the letter information to be formed next. Commonly, as explained above, by the actuation of the switch Ss the letter information of 5 letters is to be formed as the next comment information. In this manner four kinds of comment information in a total amount of 20 letters can be formed.

In order to develop and indicate the four kinds of comment information, the switch Sf is operated in the current time display mode. Responsive to the activation of the switch Sf, the controller 8 causes the RAM 10 to develop in turn the four kinds of comment information. If it is assumed, for example, that the first kind of comment information as formed is "TO- - -", the second kind of comment information as formed is "LOVE-", and the third kind of comment information as formed is "ALICE", a display chain of "TO- - -LOVE-ALICE" is automatically enabled where three letters and one letter respectively following "TO" and "LOVE" are the blank information. The four kinds of comment information are displayed as a message in which case they are connected to other. This is called an automatic display of the comment information.

By the actuation of the switch Sa in the automatic display, a display called a hold display is enabled as shown in FIG. 7. More specifically, by the actuation of the switch Sa at the time the first kind of comment information continues to be indicated from one letter to another, the entire letters of the first kind of comment information are displayed in a hold manner. The switch Sa is further actuated so that the next automatic display is enabled where the second kind of comment information is pointed out. The third and fourth types of hold display and automatic display are carried out in the same manner.

According to an aspect of the present invention, various types of comment information can be automatically and sequentially shown, which is called the automatic display, by programming the various types of comment information by means of successive actuation of the switch Sf. By the actuations of the switch Sa in the automatic display, the comment information at the time the switch Sa is operated is displayed with all letters in the hold manner called the hold display.

Referring now to FIGS. 5 to 9, a specific alarm mode called an arbitrary alarm display mode is explained. In this mode, alarm time information and alarm comment information as formed are alternatively displayed. The formation of them is effected as follows:

By the actuation of the switch Sf in the comment display mode, the arbitrary alarm display mode is selected. By the actuation of the switch Ss, an arbitrary alarm time formation mode is enabled. In such a case, the switch Sa is operated so that all characters of the day-of-week display 53 are displayed in a circulating form. When any desired day of the week is illuminated, the switch Ss is activated to allow to establish the day of the week.

Subsequently, the switch Sa is operated so that time information displayed in the display element 51 is quickly advanced in a forward direction. When any desired time information is reached, the switch Ss and, in addition, the switch Sa are operated so that time information shown in the minute digits is quickly advanced. When any desired minute information is pointed out, the switch Ss is operated so that comment selection mode or comment formation mode is selected. In the comment selection mode or comment formation mode, a specific type of comment information to be indicate in response to the coming of the alarm time, called alarm comment information, can be formed.

In this comment formation mode, selection of the kind of comment information to be formed can be indicated with reference to the numbers of 1 to 4. In another condition of this mode, a non-selection state of the comment information is provided where the blank information entirely occupies the display element 51 and, in addition, none of elements of the indicator 52 is indicated. In this example, the non-selection state occurs immediately when the comment formation mode is selected, with the object that the coming of the comment formation mode is easy to recognize.

By the actuation of the switch Sa in the non-selection state of the comment information, the first kind of alarm comment information is developed from the RAM 10 as a comment 1. For example, the comment 1 is "PARTY" in FIG. 9. The comment 1 is pointed out in the display element 51. Responsive to the actuation of the switch Sa, comment 2, say, "KAIGI" (corresponding to a "conference") is shown as the second kind of alarm comment information. In the same manner, responsive to each of operation of the switch Sa, the four kinds of comment information and code information corresponding to the non-selection state of the comment information are in turn generated and eventually shown in the display element 51. By the activation of the switch Ss when any desired comment information is shown, the number corresponding to the comment information is introduced into and stored in the alarm counter 6, in which case the arbitrary alarm display mode is selected again.

By the actuation of the switch Sf in the arbitrary alarm display mode, an additional automatic alarm display mode is selected wherein the same operation as the arbitrary alarm display mode can be enabled. The automatic alarm display mode is different from the arbitrary alarm display mode in that the former is used to provide the alarm sound in every day and the latter is used to provide the alarm sound only in the day the alarm is formed.

By the actuation of the switch Sf after the alarm time information and the alarm comment information have been completely formed regarding the arbitrary alarm display mode or the automatic alarm display mode, the current time display mode is selected.

By the fact that there is equivalency between the current time obtained by the time keeping counter 3 and the alarm time information applied to the alarm counter 6, the detection circuit 7 generates the detection signals entering the controller 8. Responsive to the detection signals, the controller 8 causes the alarm time information to be transferred from the alarm counter 6 to the display element 51 through the decoder 4. The alarm time information is pointed out in the display element 51.

The controller 8 addresses the number of comment information stored in the alarm counter 6. In accordance with the number, it allows the second code information, stored in the RAM 10 as the comment information and corresponding to the number, to develop. The second code information is shown in the display element 51 through the decoder 4. The display element 51 points out the alarm time information, example, 14:00" and the comment information, say, "PARTY", alternatively.

In the case where the switch Ss is operated in the non-selection state as to the comment information formation mode, it is detected that the alarm counter 6 does not contain information as to the number of the comment information in spite of the coming of the alarm time. Only the alarm sound is delivered without any change of the display conditions of the current time and any generation of the comment information, which is identical to the conventional alarm electronic timepiece.

The construction of the display element 51 is not limited to the dot matrix display having 7(column)×30 (row), although so described in this example. Any type of either the active (i.e., light-emitting diode) or passive (i.c., liquid crystal or electrochromic) display can be employed for the electronic timepiece 10 as far as it shows figures, alphabetical letters, and any other digital or symbolic drawings.

In the above stated embodiment of the present invention, the current time information, the alarm time information, and the comment information are all displayed in the same display of the display element 51 by alternatively switching. These types of information can be individually shown in separate displays. Preferably, in such a case, at least two distinct display units are provided for indicating the current time information and the alarm time information, respectively. One of the two distinct display units is changed to indicate the comment information in place of the current time information, in response to the arrival of the alarm time.

Further, in the above described embodiment of the present invention, the ROM 81 stores many pieces of code information corresponding to one letter, wherein they are combined to each other to form a particular kind of comment information comprising several letters. Alternatively, it can contain many pieces of code information corresponding to a plurality groups of comment information preliminarily formed, wherein desirable quantities of the code information are selectively generated so that the RAM 10 stores them.

In place of the ROM 81, an up-down counter means may be provided as the first memory so that its counted contents of code information are changed to the letter information by means of an additional decoder means. The letter information enters the RAM 10 and is shown in the display element 51.

Figure 10:
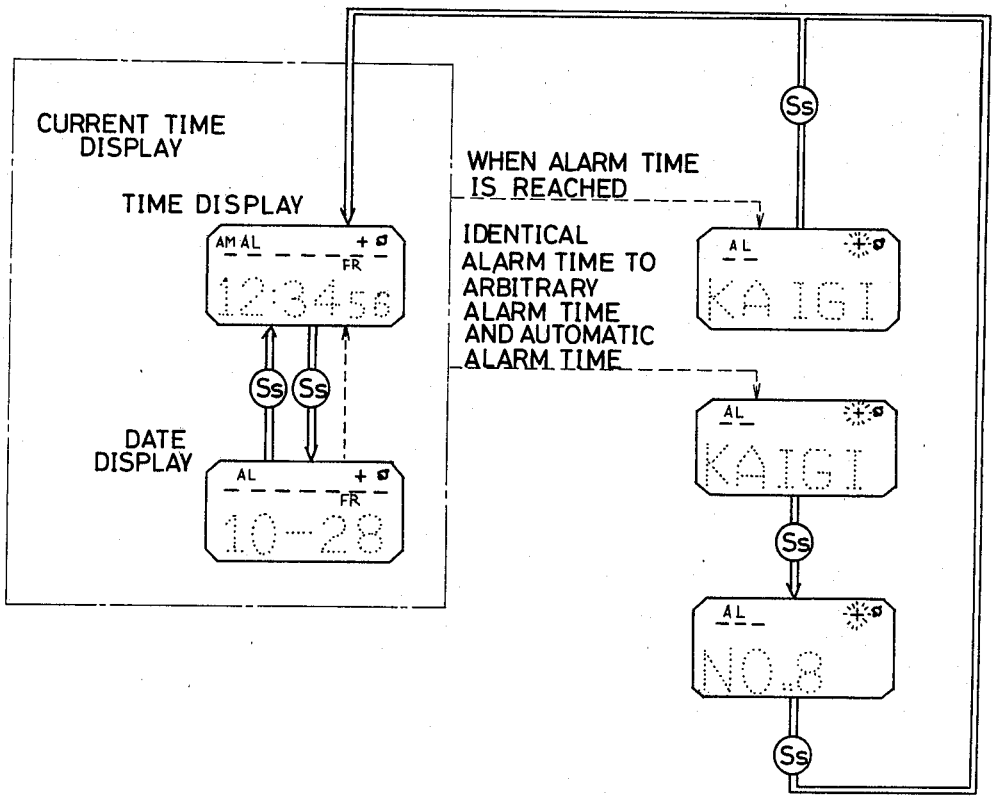
FIG. 10 shows a further specific flow chart representing operations of the electronic timepiece in its alarm time conditions for use with the present invention.

FIG. 10 shows a further specific flow chart representing operations of the electronic timepiece 10 in its alarm time conditions for use with the present invention.

In the case where different kinds of alarm time are established as to the arbitrary alarm time information and the automatic alarm time information, each of the comment information about them is developed in the different kinds of alarm time. It is indicated in the display element 51. However, if the identical alarm time is formed as to the arbitrary alarm time information and the automatic alarm time information, the alarm time formed in connection with the former is firstly generated and indicated, and, secondarily, in response to the actuation of the switch Ss, the alarm time formed in connection with the latter is developed and indicated.

That is, in the case of the identical alarm time, the operation of the arbitrary alarm time information has priority of the automatic alarm time information in providing the respective types of comment information for displaying purposes.

As shown in FIG. 10, "KAIGI" (corresponding to a "conference") is shown as the arbitrary alarm mode and then "No. 8" is pointed out as the automatic alarm mode. It is represented that the conference is held in a room of NO. 8. By the activation of the switch Ss during the display of the automatic alarm mode, the current time display mode is selected.

Unless the switch Ss is operated, the display of comment information regarding the arbitrary alarm mode and the automatic alarm mode continues to be sustained. Even if the operator fails to catch the alarm sound, he can obtain at least the display of the comment information. In the case where, while a kind of comment information concerning the arbitrary alarm mode continues to be shown, the alarm time concerning the automatic alarm mode comes, it is preferable that the display of the comment information presently indicated is not changed and the alarm sound with respect to the automatic alarm mode is provided. In response to the operation of the switch Ss, thereafter, the other kind of comment information for use with the automatic alarm mode is pointed out.

At least two kinds of alarm time can be formed in the same day by canceling functions of forming the day of the week in the arbitrary alarm mode, for example. In such a case, the priority function as described in FIG. 10 can be adopted even if the identical alarm time is formed.

Some features of the present invention are summarized as follows:

1. Any type of comment information can be formed which is developed as a message in response to the actuation of a switch.
2. The comment information can be provided in connection with an alarm. When the current time is identical to alarm time, the comment information is generated and indicated in addition to an alarm sound.
3. Even in forming pieces of the comment information, a non-selection state of the comment information occurs wherein only the current time information continues to be shown by preventing any display of the comment information, even in the case of the coming of the alarm time, the alarm time being formed in the non-selection state.
4. In forming the comment information, the blank information, "-" is indicated the code information of which is stored in a memory. This results in facilitating the formation of the comment information.
5. Where there is a possibility of forming the identical alarm time to at least two distinct types of alarm modes, priority functions are used in showing the comment information concerning the at least two types of the alarm modes in response to the coming of the identical alarm time.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An electronic timepiece comprising:

means for providing horological information representative of current time information;

display means responsive to the providing means for indicating a visual display of the horological information;

means for storing a plurality of types of code information representing separate comment frames of symbolic information;

means coupled to the storing means for independently selecting code information of any one of said separate comment frames, in which the code information is generated to enable the formation of a comment in said frame, and a comment formation mode, in which the symbols in the comment frame are selected to form said comment;

means responsive to the selecting means for instructing said display means to indicate the symbolic information of one or more comment frames as a message thereon;

the storing means comprising first memory means and second memory means, the first memory means containing the types of the code information representing separate comment frames and providing the respective symbols of the comment in a circulating manner in response to the comment frame selected by the selecting means, and the second memory means being responsive to the types of the code information generated by the first memory means for storing coded forms of the respective comments formed during the comment formation mode;

means responsive to the instructing means for extracting the coded forms of the respective comments from the second memory means;

means responsive to the extracting means for converting the coded forms of the respective comments into the symbolic information comprising the comments; and said display means being responsive to the converting means for displaying the symbolic information as the message thereon.

2. The electronic timepiece as set forth in claim 1 wherein said message comprises a plurality of comment frames and said display means includes an automatic mode of operation wherein said comment frames are enabled seriatum thereon to create a dynamic display and a hold mode wherein a selected one of said comment frames is displayed in a static condition to the exclusion of the other comment frames.

3. An electronic timepiece of the type providing alarm and a message corresponding thereto, comprising:

means for providing horological information representative of current time;

means for generating information representative of alarm time;

means responsive to the occurrence of the correspondence of the current time to the alarm time for generating a specific alarm;

display means responsive to the providing means for indicating a visual display of the horological information;

means for storing a plurality of types of code information representing separate comment frames of symbolic information;

means coupled to the storing means for independently selecting code information of any one of said separate comment frames, in which the code information is generated to enable the formation of a comment in said frame, and a comment formation mode, in which the symbols in the comment frame are selected to form said comment;

means responsive to the selecting means for instructing said display means to indicate the symbolic information of one or more comment frames as a message thereon;

the storing means comprising first memory means and second memory means, the first memory means containing the types of the code information representing separate comment frames and providing the respective symbols of the comment in a circulating manner in response to the comment frame selected by the selecting means, and the second memory means being responsive to the types of the code information generated by the first memory means for storing coded forms of the respective comments formed during the comment formation mode;

means responsive to the correspondence of the current time to the alarm time for enabling the generating means to generate the specific alarm and the generation of the particular type of coded forms of the respective comments from the second memory means;

said display means being responsive to the enabling means for converting the coded forms of the respective comments into the symbolic information thereon; and means responsive to the occurrence of the correspondence of the current time to alarm time for switching said display means from the display of horological information to symbolic information.

* * * * *